United States Patent [19]

Tom

[11] 4,282,615

[45] Aug. 11, 1981

[54] CARPENTER'S SURFACE PROTECTING TOOL

[76] Inventor: Dale M. Tom, Rte. 1, Norwich, Ohio 43767

[21] Appl. No.: 20,959

[22] Filed: Mar. 13, 1979

[51] Int. Cl.[3] ..... B25F 1/00; B25C 3/00

[52] U.S. Cl. ..... 7/164; 7/169; 145/46; 145/1 R

[58] Field of Search ..... 145/46, 30 R, 1 R, 1 B, 145/129; 7/164, 169

[56] References Cited

U.S. PATENT DOCUMENTS

| | | | |
|---|---|---|---|
| Re. 28,159 | 9/1974 | Litz | 145/46 |
| 2,635,237 | 4/1953 | Langer | 145/46 |
| 2,878,476 | 3/1959 | Auchard | 145/1 R |
| 3,338,279 | 8/1967 | Kruttschnitt | 145/46 |
| 4,139,036 | 2/1979 | Regan | 145/46 |

FOREIGN PATENT DOCUMENTS

| | | | |
|---|---|---|---|
| 674685 | 11/1963 | Canada | 145/46 |
| 2403851 | 8/1975 | Fed. Rep. of Germany | 145/46 |
| 5414 | of 1893 | United Kingdom | 145/46 |

*Primary Examiner*—Stephen G. Kunin
*Assistant Examiner*—Roscoe V. Parker
*Attorney, Agent, or Firm*—Cushman, Darby & Cushman

[57] ABSTRACT

A device for protecting a surface into which fasteners are driven. The device includes a shield portion and a handle substantially parallel to the shield. An opening is provided in the shield portion large enough to accommodate the head of a nail, and an elongated open slot extends from an edge of the shield portion. Indicia are provided spaced a predetermined distance from the edge for gauging door trim setback. A tubular member upstands from the shield and has interior dimensions great enough to receive a screwdriver blade to guide the screwdriver as it drives the screw into the surface on which the shield portion is disposed.

7 Claims, 4 Drawing Figures

CARPENTER'S SURFACE PROTECTING TOOL

BACKGROUND AND SUMMARY OF THE INVENTION

There have been suggestions in the prior art for nail holders and shields and the like for holding a nail during driving and/or protecting surfaces into which the nails are driven. Such prior devices have been cumbersome to positively locate in place during use, and have not had a great deal of versatility.

According to the present invention, apparatus is provided for protecting a surface into which fasteners are driven which may be readily held in place during use, and which apparatus is versatile. The apparatus according to the present invention is useful in protecting a surface into which nails are driven straight or in toenail fashion, for protecting the surface from damage from a screwdriver should the screwdriver slip while a screw is being driven into the surface to be protected, and indicia means are provided on the apparatus for use as a jamb trim set-back gauge for use to gauge trim set-back from the edge of the door jamb.

According to the present invention, apparatus for protecting a surface into which fasteners are driven is provided comprising a shield portion having a flat under-surface adapted to be disposed on the surface to be protected and a handle portion operatively connected to the shield portion. Means are provided defining at least one opening in the shield portion that is large enough to accommodate the head of a nail. Also, means are provided defining a screw-receiving opening in the shield portion, and including a tubular member upstanding from the shield portion and the screw-receiving opening, the tubular member having interior dimensions great enough to receive a screwdriver blade therein to guide a screwdriver as it drives a screw into a surface on which the shield is disposed. The apparatus preferably is made of an integral piece of impact-resistant plastic, and the shield portion has an upper-surface opposite the under-surface, the upper surface being flat except for the tubular member. One or more circular openings may be provided large enough to accommodate a nail head when driven straight through the shield portion, and an elongated open slot from an edge of the shield portion also is preferably provided, through which a nail may be driven toenail fashion. Indicia means are formed on the shield portion spaced from the edge of the shield portion in which the second opening is formed, for gauging door trim set-back.

According to another aspect of the present invention, apparatus for protecting a surface into which fasteners are driven is provided comprising a substantially polygon-shaped shield portion having a flat under-surface adapted to be disposed on the surface to be protected, the shield portion including first and second substantially parallel edges and third and fourth edges, at least one of which is substantially perpendicular to the first edge; and a handle portion operatively connected to and extending away from the shield portion second edge. Means are provided defining the first opening in the shield portion large enough to accommodate a nail head when driven straight through the shield, means defining a second opening in the shield portion extending as an elongated open slot from the first edge, and indicia means being provided formed spaced a predetermined distance from the first edge and formed on at least one of said third and fourth edges, for gauging door trim set-back. Preferably both the third and fourth edges are substantially perpendicular to the first edge, and the indicia means comprise one mark disposed three-eighths ($\frac{3}{8}$) inch from the first edge along the fourth edge, and another mark disposed one-quarter ($\frac{1}{4}$) inch from the first edge along the third edge. An intermediate portion is provided interconnecting the handle and the shield, the intermediate portion making a positive acute angle with both the shield and the handle portions so that the handle portion is generally parallel to the shield portion.

It is the primary object of the present invention to provide a simple and versatile tool for protecting a surface into which fasteners are driven. This and other objects of the invention will become clear from inspection of the detailed description of the invention, and from the appended claims.

Figure 1:
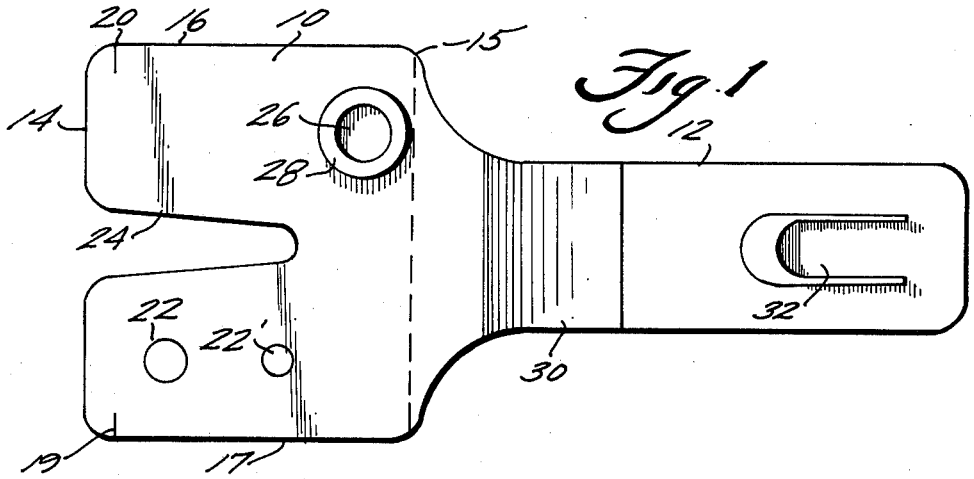
FIG. 1 is a top plan view of an exemplary tool according to the present invention.

FIG. *3a* is a perspective view of the tool of FIG. 1 in use when a screw is being driven into the surface on which the tool is disposed; and FIG. *3b* is a perspective view of the tool of FIG. 1 in use for protecting a surface from nails being driven into the surface, and indicating the use of the tool for gauging jamb trim set-back.

DETAILED DESCRIPTION OF THE DRAWINGS

In the drawings, a carpenter's tool for protecting a surface S (see FIGS. *3a* and *3b*) into which a fastener is driven is illustrated. The tool comprises a shield portion 10 having a flat under-surface A (see FIG. 2) adapted to be disposed on the surface S to be protected, and a handle portion 12 operatively connected to the shield portion 10. The shield portion 10 is preferably substantially polygon-shaped, and includes first and second substantially parallel edges 14, 15 (see FIG. 1) respectively, and third and fourth edges 16, 17, at least one of which (and preferably both) is substantially perpendicular to the first edge 14. Indicia means, such as the marks 19, 20, are formed spaced a predetermined distance from the first edge 14 along the edges 16, 17, for gauging door trim set-back. Preferably, the mark 19 is disposed three-eighths ($\frac{3}{8}$) inch from the edge 14 along the fourth edge 17, and the mark 20 is disposed one-quarter ($\frac{1}{4}$) inch along the third edge 16 from the first edge 14.

The tool according to the invention further comprises means defining at least one opening in the shield portion 10 that is large enough to accommodate the head of a nail (N, N'—see FIG. *3b*). Preferably, one or more first openings 22, 22' are provided which are large enough to accommodate a nail head when driven straight through the shield portion. For instance, the opening 22 may have a three-eighths ($\frac{3}{8}$) inch diameter, and the opening 22' a quarter ($\frac{1}{4}$) inch diameter. The opening-defining means also preferably comprises means defining a second opening extending as an elongated open slot 24 from edge 14, through which a nail may be driven toenail fashion (see N' in FIG. *3b*).

Figure 3A:
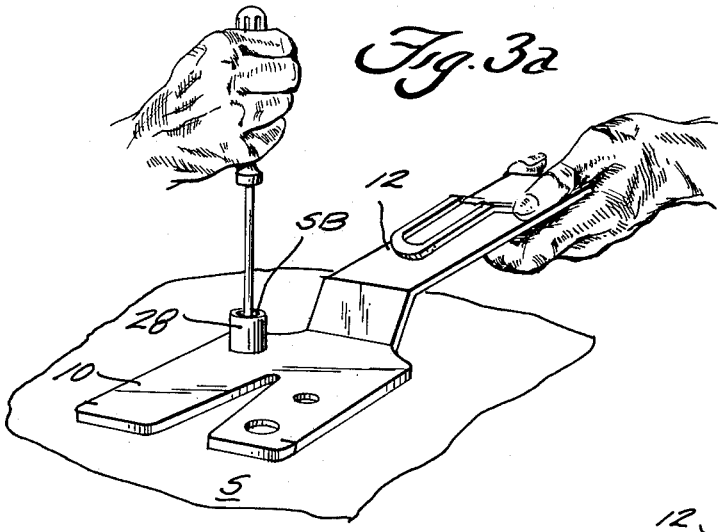

The tool further comprises means defining a screw-receiving opening 26 in the shield portion 10, such means including a tubular member 28 upstanding from the shield portion 10. The tubular member 28 has interior dimensions great enough to receive a screwdriver blade SB (see FIG. 3*a*) therein to guide a screwdriver as it drives a screw into a surface in which the shield portion 10 is disposed. For instance, the tubular member can be circular in cross-section having an interior diameter of one-half ($\frac{1}{2}$) inch, and the tubular member can upstand from the upper-surface B approximately one-half ($\frac{1}{2}$) inch.

Figure 2:
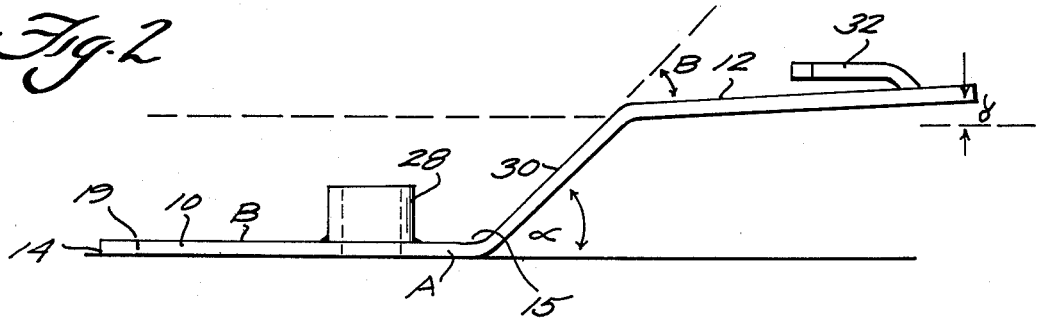
FIG. 2 is a side view of the tool of FIG. 1.

The handle portion 12 is preferably connected to the shield portion 10 by an intermediate portion 30 which forms a positive acute angle with both said shield (the angle $\alpha$—see FIG. 2) and the handle portions (angle $\beta$—see FIG. 2). The handle portion 12 is preferably disposed in a plane substantially parallel to the plane of the shield portion 10, although it is desirable that the handle portion 12 make a small positive angle $\gamma$(see FIG. 2) with respect to a plane P extending parallel to the shield portion 10 and passing through the connection between the handle portion 12 and intermediate portion 30. The angle $\alpha$ preferably is about 45° and the angle $\gamma$ about 3°, with the handle portion 12 spaced approximately $1\frac{1}{4}$ inch from the shield portion 10. With the handle portion 12 interconnected to the shield portion 10 in this manner, and located with respect to the edges 14, 16, and 17 of the shield portion 10 as indicated in the drawings, the tool may be readily used for all the functions for which it is designed and may be readily positively positioned in place.

Preferably, the portion 10, 12, and 30 are formed of an integral piece of impact-resistant plastic, such as a polycarbonate. Additionally, a belt-clip portion 32 also can be formed on the handle portion 12 to facilitate ready transportion of the tool at the job site.

Figure 3B:
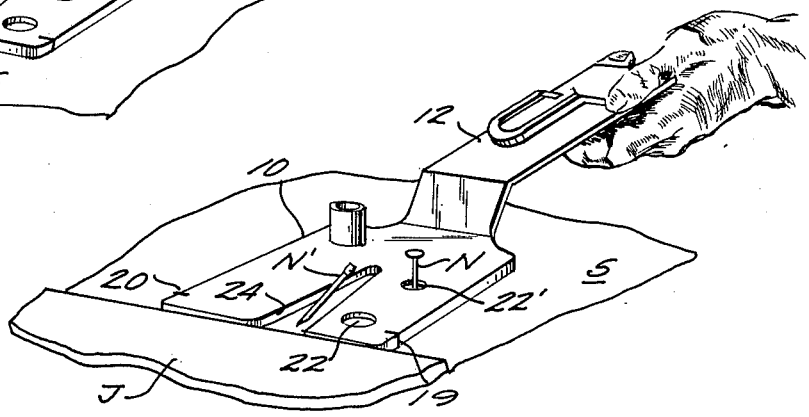

In using the tool according to the present invention for protecting a surface into which a screw is driven, the tool is positioned in the manner illustrated in FIG. 3*b* with the under-surface A on the surface S to be protected, the tool being positioned over a screw already started in the surface S, or the screw being introduced through the tubular member 28 into the surface S. The carpenter then can drive the screw into the surface with the screwdriver blade SB by rotation thereof, and should the screwdriver blade SB slip, it cannot slip into contact with the surface S, being retained by the interior walls of the tubular member 28.

For use of the tool according to the invention to protect a surface S into which nails are being driven, the tool is placed on the surface S—as indicated in FIG. 3*b*—with the under-surface A thereof flushed with the surface S. If the nail N is to be driven straight into the surface S, an opening 22, 22' is chosen which has a diameter closest to, but larger than, the diameter of the nail head, and the nail is driven into the surface S through that opening (opening 22' in FIG. 3*b*). Should the hammer not strike the nail exactly, the surface S will still not be damaged since the hammer will strike the shield portion 10 rather than the surface S. If a nail is to be driven toenail fashion, as indicated by nail N' in FIG. 3*b*, it is merely introduced through slot 24 and hammered into place, the shield portion 10 again protecting the surface S from stray blows from the hammer.

For use of the tool according to the invention as a jamb trim set-back gauge, as illustrated in FIG. 3*b*, the edge 14 is moved into flush engagement with the edge of the door jamb J. The mark 19 then indicates a position three-eighths ($\frac{3}{8}$) inch from the door jamb J, and the mark 20 indicates a position one-quarter ($\frac{1}{4}$) inch from the door jamb J, and the appropriate markings can be made on the surface S adjacent to the marks 19, 20.

Thus, it will be seen that according to the present invention a simple and versatile carpenter's tool has been provided for protecting a surface into which fasteners are to be driven. While the invention has been herein shown and described in what is presently conceived to be the most practical and preferred embodiment thereof, it will apparent to those of ordinary skill in the art that many modifications may be made thereof within the scope of the invention, which scope is to be accorded that broadest interpretation of the appended claims so as to encompass all equivalent structures and devices.

What is claimed is:

1. Apparatus for protecting a surface into which fasteners are driven, comprising an integral piece of impact-resistant plastic including:

a shield portion having a flat under-surface adapted to be disposed on the surface to be protected;

a handle portion operatively connected to said shield portion;

means defining at least one opening in said shield portion that is large enough to accommodate the head of a nail;

means defining a screw-receiving opening in said shield portion, and including a tubular member upstanding from said shield portion and said screw-receiving opening and surrounded by said shield portion, said tubular member having interior dimensions great enough to receive a screwdriver blade therein to guide a screwdriver as it drives a screw into a surface on which said shield portion is disposed;

said shield portion having an upper-surface opposite said under-surface, said upper-surface being flat except for said tubular member; and an intermediate portion interconnecting said handle portion and said shield portion, said intermediate portion making a positive acute angle with both said shield and said handle portions, and so that a plane containing said handle portion is closer to said shield portion upper-surface than under-surface, and so that said handle portion makes a small positive angle with respect to a plane extending parallel to said shield portion.

2. Apparatus as recited in claim 1 wherein said means defining at least one opening in said shield portion large enough to accommodate a nail head comprises means defining a first opening large enough to accommodate a nail head when driven straight through the shield portion, and means defining a second opening extending as an elongated open slot from an edge of said shield portion, through which a nail may be driven toenail fashion.

3. Apparatus as recited in claim 2 wherein said handle portion operatively extends from an edge of said shield portion opposite said edge in which said second opening is formed.

4. Apparatus as recited in claim 2 further comprising indicia means formed spaced from said edge of said shield portion in which said second opening is formed, for gauging door trim set-back.

5. Apparatus as recited in claim 1 further comprising a belt clip formed on said handle portion.

6. Apparatus for protecting a surface into which fasteners are driven, comprising a substantially polygon-shaped shield portion having a flat under-surface adapted to be disposed on the surface to be protected; said shield portion including first and second substantially parallel edges, and third and fourth edges each substantially perpendicular to said first edge;

a handle portion operatively connected to and extending away from said shield portion second edge;

means defining an opening in said shield portion extending as an elongated open slot from said first edge;

indicia means formed spaced a predetermined distance from said first edge and formed on said third and fourth edges, for gauging door trim set-back; said indicia means comprising one mark disposed $\frac{3}{8}''$ from said first edge along said fourth edge, and another mark disposed $\frac{1}{4}''$ from said first edge along said third edge; and said shield portion having an upper-surface opposite said under-surface, said upper-surface being flat except for a tubular member extending upwardly therefrom, said tubular member having an internal bore extending through said shield portion and open at both ends, and having interior dimensions great enough to receive a screwdriver blade therein to guide a screwdriver as it drives a screw into a surface on which said shield portion is disposed.

7. Apparatus as recited in claim 6 further comprising an intermediate portion interconnecting said handle portion and said shield portion, said intermediate portion making a positive acute angle with both said shield and handle portions, and so that said handle portion is generally parallel to said shield portion.

* * * * *